United States Patent [19]

Kataoka

[11] Patent Number: 4,693,431

[45] Date of Patent: Sep. 15, 1987

[54] WINDING SHAFT FOR SHEET REWINDER

[76] Inventor: Hiroshi Kataoka, 3686, Sangawacho, Iyomishima-shi, Ehime 799-04, Japan

[21] Appl. No.: 815,013

[22] Filed: Dec. 31, 1985

[51] Int. Cl.[4] ..... B65H 75/24; B65H 23/195; B23B 5/22

[52] U.S. Cl. ..... 242/72 B; 242/75.51; 242/56.9; 279/2 A

[58] Field of Search ..... 242/56.9, 72 R, 72 B, 242/68.2, 46.4, 75, 75.5, 75.51, 75.53; 279/2 R, 2 A; 269/48.1

[56] References Cited

U.S. PATENT DOCUMENTS

| | | | |
|---|---|---|---|
| 3,010,671 | 11/1961 | Brown | 242/72 B X |
| 3,817,468 | 6/1974 | Smolderen et al. | 242/72 B X |
| 3,904,144 | 9/1975 | Gattrugeri | 279/2 A |
| 4,026,491 | 5/1977 | Bostroem | 242/56.9 X |
| 4,218,029 | 8/1980 | Schwenzfeier et al. | 242/56.9 |

FOREIGN PATENT DOCUMENTS

| | | | |
|---|---|---|---|
| 55-16941 | 5/1980 | Japan . | |
| 55-37461 | 9/1980 | Japan . | |
| 48301 | 1/1983 | Japan | 242/72 R |
| 58-11454 | 1/1983 | Japan . | |
| 59-13418 | 3/1984 | Japan . | |

*Primary Examiner*—Stuart S. Levy
*Assistant Examiner*—David Werner
*Attorney, Agent, or Firm*—Oblon, Fisher, Spivak, McClelland & Maier

[57] ABSTRACT

A winding shaft for a sheet rewinder comprises a hollow shaft provided in its peripheral wall with through-holes, a plurality of drum rings rotatably fitted around the hollow shaft, plungers inserted one in each through-hole, support rings provided at the opposite ends of the drum rings, and urging means disposed in the hollow shaft and adapted for outwardly urging the plungers. The hollow shaft is brought into engagement with the drum rings by means of the plungers being outwardly projected by the urging force of the urging means, consequently to permit the torque of the hollow shaft to be transmitted to the drum rings.

6 Claims, 11 Drawing Figures

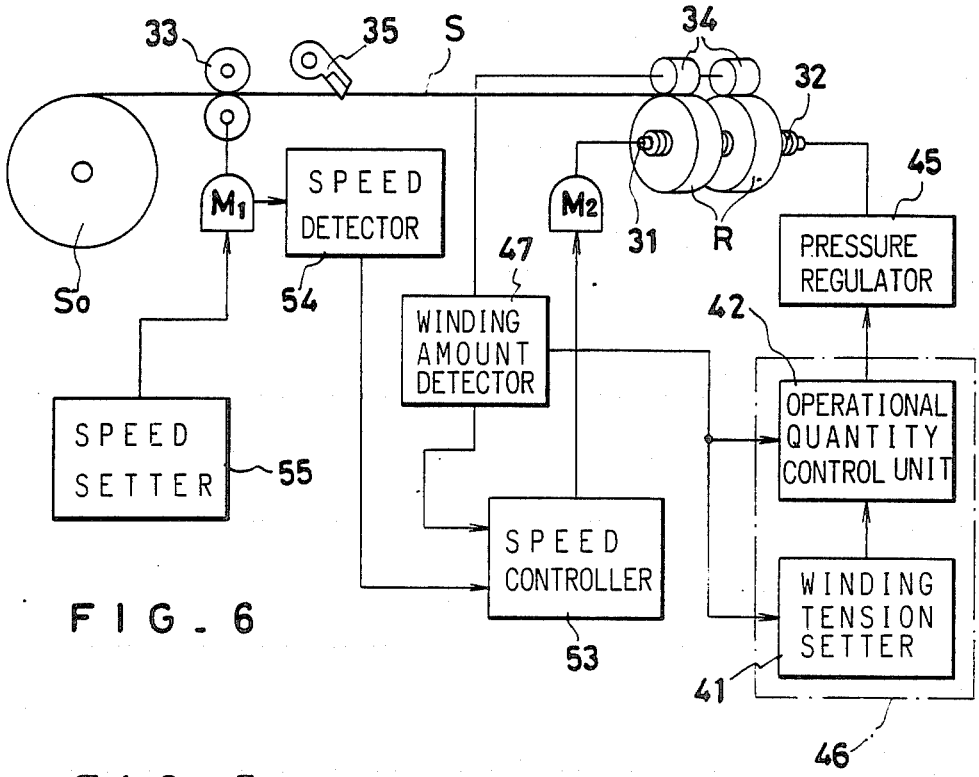
FIG. 6
FIG. 7
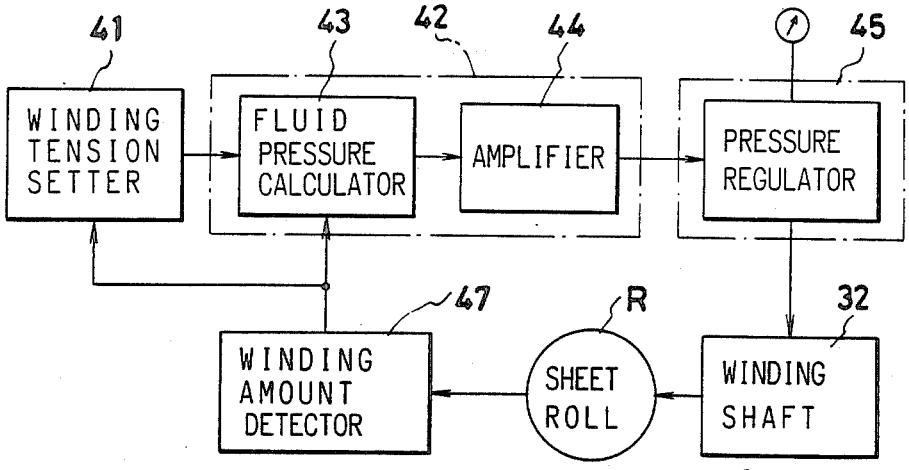

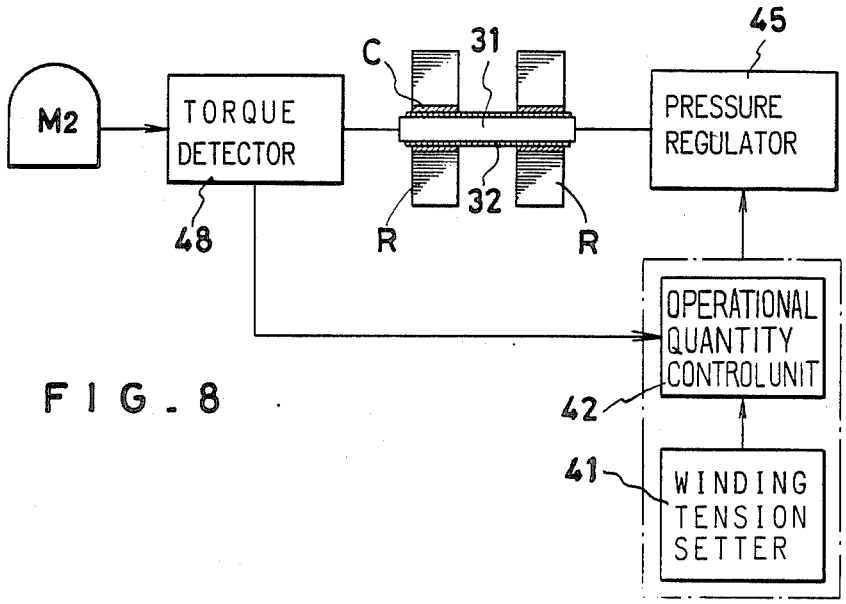
FIG. 8
FIG. 9
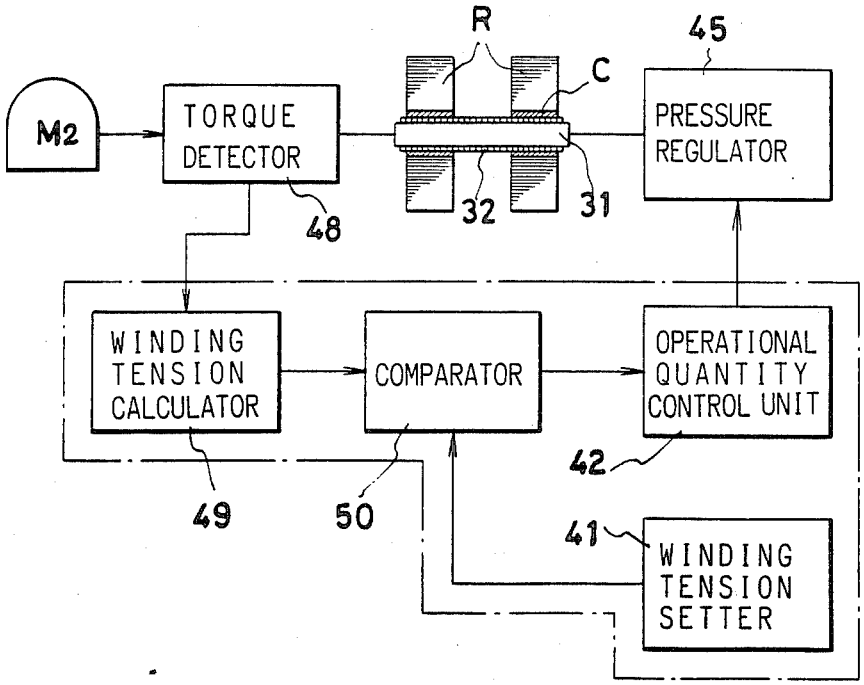

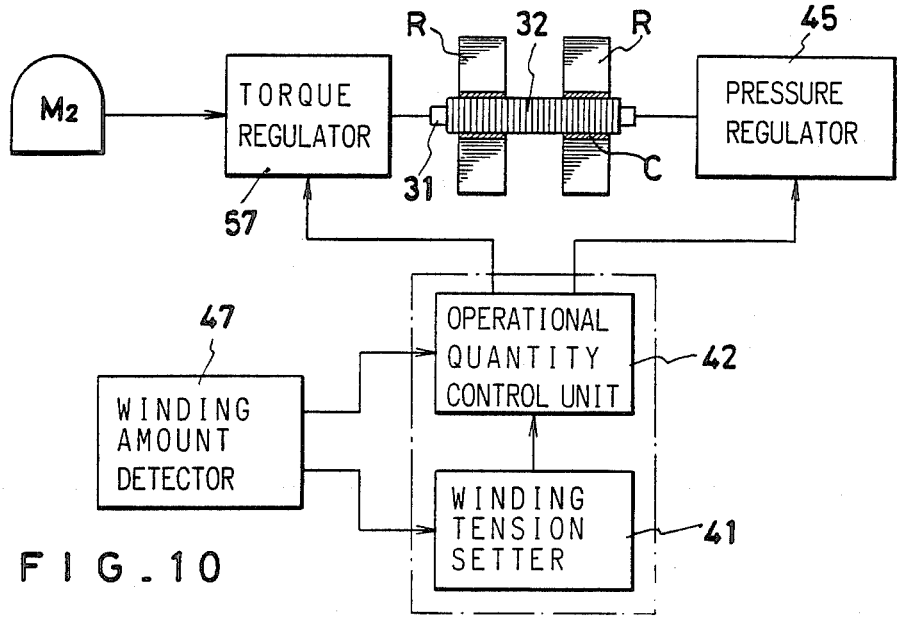
FIG. 10
FIG. 11
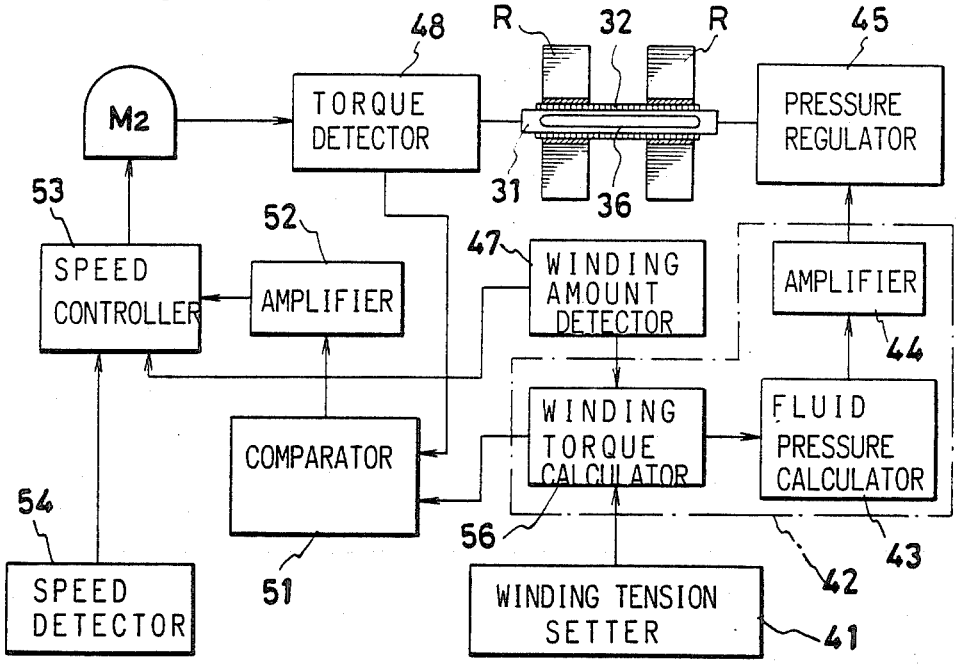

WINDING SHAFT FOR SHEET REWINDER

FIELD OF THE INVENTION AND RELATED ART STATEMENT

This invention relates to a winding shaft for a sheet slitter/rewinder, in which a plurality of slit sheets slit by a slitter are taken up on cores fitted on drum rings rotatably fitted on a drive shaft driven for rotation by the torque of the drive shaft transmitted to the drum rings via friction members in frictional engagement with the drum rings.

In a sheet rewinder in which a plurality of slit sheets obtained from a wide sheet by use of a slitter are taken up on a winding shaft, after slit sheet rolls have been formed by taking up a prescribed amount of sheet, the winding shaft is taken out from the rewinder together with the sheet rolls and the winding shaft is then withdrawn from the sheet rolls, whereafter the winding shaft is then mounted again on the rewinder.

Recently, there has been proposed a sheet slitter/-rewinder, which is provided with a winding shaft withdrawal mechanism, and predetermined slit sheet rolls formed on the winding shaft are taken out from the winding shaft and transported to the outside while the winding shaft is held at a set position for the winding, as disclosed in U.S. Pat. No. 4,431,142.

Meanwhile, there are sheet roll cores of different diameters, e.g., 3 inches and 6 inches, and cores of given diameters are used according to purpose. It is uneconomical to prepare winding shafts of different diameters corresponding to the cores of the respective diameters. Therefore, drum rings having different outer diameters corresponding to the respective core diameters are prepared, and only the drum rings are replaced according to the inner diameter of the core used for the winding.

Japanese Patent Publication No. SHO 55(1980)-16941 discloses a winding shaft, which comprises a drive shaft driven for rotation and having the outer periphery formed with axially continuous grooves, expansible tubes accommodated in the axial grooves, and brake shoes fitted on the outer periphery of the drive shaft. The expansible tubes are outwardly expanded by being supplied with air so as to bring the brake shoes into frictional engagement with the inner periphery of carriers or core which are rotatably fitted on the drive shaft for taking up sheets. This winding shaft, however, has a complicated construction and requires cumbersome assembly. In addition, the replacement and maintenance of drum rings requires great deal of time and labor.

Japanese Patent Publication No. SHO 55(1980)-37461 discloses a winding shaft, which comprises a hollow shaft, an expansible air tube accommodated therein and three-piece split rings provided on the air tube. Rods project outwardly from the individual pieces of the three-piece slit rings, each rod carrying a steel ball provided at the free end. The steel balls at the end of the rods are urged into engagement with grooves formed in the inner periphery of drum rings, thereby making the drum rings integral with the hollow shaft.

In this winding shaft, however, high machining precision and assembling precision are required to obtain registration between the steel balls and grooves. In addition, each steel ball at the end of each rod is in contact with the associated drum ring at a fixed position thereof. Therefore the frictional surface of the drum ring, i.e., the inner periphery thereof, with the steel ball is liable to be worn locally, resulting in deviation of the transmitted torque. Further, while the drum rings are held coaxially with the hollow shaft by the urging force of the rods while the load is light, i.e., while the winded sheet roll diameter is small, as the sheet roll diameter increases the drum rings deviate with respect to the drive shaft due to the load of the sheet rolls acting on the drum rings. In this case, the drum ring inner periphery and drive shaft outer periphery are rotated in contact with each other, thus producing scars and scratches on the drum ring inner periphery.

OBJECT AND SUMMARY OF THE INVENTION

An object of the invention is to provide a winding shaft for a sheet slitter/rewinder which permits uniform and accurate transmission of the torque of the hollow shaft to cores over the entire length thereof.

Another object of the invention is to provide a winding shaft for a sheet slitter/rewinder which is simple in construction and capable of easy assembly, machining and maintenance.

A further object of the invention is to provide a winding shaft for a sheet slitter/rewinder, which can be readily assembled without need of high precision positioning of drum rings and frictionally driven sections and has excellent durability.

To attain the above objects of the invention, there is provided a winding shaft for a sheet rewinder which comprises a hollow shaft having a plurality of through-holes formed in the peripheral wall at predetermined intervals in the circumferential and axial directions, each through-hole having an inner projection provided at the inner end of the hole, a plurality of drum rings rotatably fitted on the hollow shaft to close the outer open ends of the through-holes, the inner periphery of the drum rings serving as a frictional surface, plungers inserted one in each through-hole, each plunger having at least one hook portion greater in size than the inner diameter of the inner projection, support rings provided at the opposite ends of the inner periphery of the drum rings, the inner periphery of the support rings being in contact with the outer periphery of the hollow shaft, and urging means for outwardly urging the plungers through the interior of the hollow shaft.

With this winding shaft, a slight variation of the position of contact between the drum ring frictional surface and plunger has no adverse effect on the results. Thus, the shaft can be easily machined and assembled, and moreover local wear of the drum rings can be suppressed. Further, the torque of the hollow shaft can be reliably transmitted to the drum rings. Further, the plungers can be readily inserted into and taken out from the through-holes from the side of the outer periphery of the hollow shaft. Moreover, since the support rings are provided in direct contact with the inner periphery of the drum rings and the outer periphery of the hollow shaft to support the drum rings in coaxial relation to the hollow shaft, the hollow shaft and drum rings are rotated without possibility of eccentric deviation from one another. It is thus possible to eliminate scaring and scratching of the drum ring inner periphery in frictional contact with the plunger, thus eliminating variations in the frictional force and maintaining accurate transmitted torque.

BRIEF DESCRIPTION OF THE DRAWINGS

FIG. 6 is a schematic representation of a system for explaining the slit sheet winding control using the winding shaft according to the invention;

FIG. 7 is a block diagram showing a winding tension controller shown in FIG. 6;

FIG. 8 is a block diagram showing a first example of a frictional torque controller;

FIG. 9 is a block diagram showing a second example of the frictional torque controller;

FIG. 10 is a block diagram showing a third example of the frictional torque controller; and FIG. 11 is a block diagram showing a fourth example of the frictional torque controller.

DETAILED DESCRIPTION OF THE PREFERRED EMBODIMENTS

Figure 1:
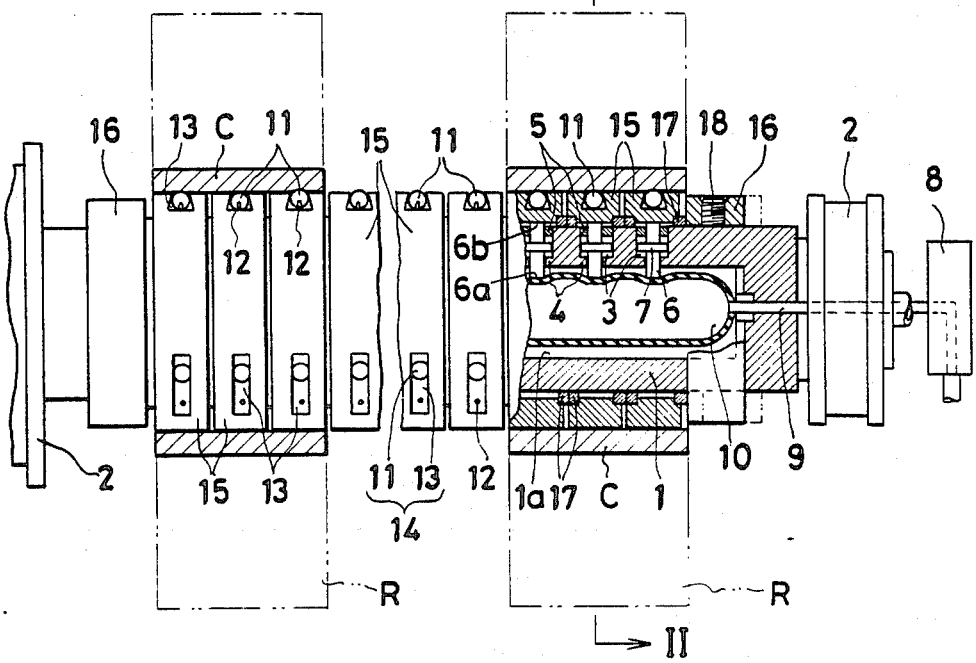
FIG. 1 is a front view, partly in section, showing a first embodiment of the winding shaft according to the invention.
Figure 2:
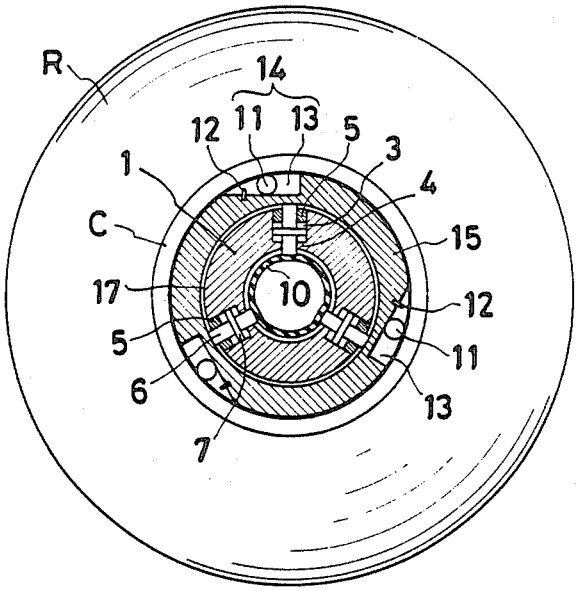
FIG. 2 is a sectional view taken along line II—II in FIG. 1.
Figure 3:
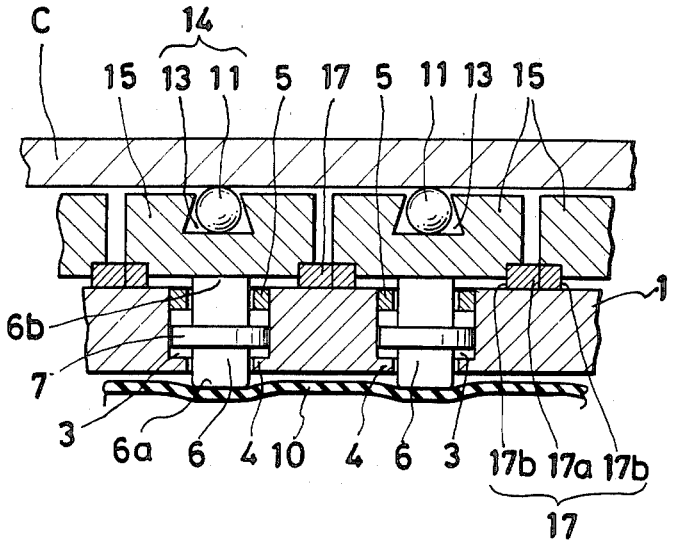
FIG. 3 is an enlarged sectional view showing an essential part of the winding shaft shown in FIG. 1.

FIGS. 1 to 3 illustrate a first embodiment of the winding shaft according to the invention. Reference numeral 1 designates a shaft having a hollow portion 1*a* rotatably mounted at opposite ends via bearings 2 in a rewinder. One end of the hollow shaft 1 is coupled to and driven by a drive mechanism (not shown). In this embodiment, the peripheral wall of the hollow shaft 1 has a plurality of sets of through-holes 3 arranged at predetermined intervals in the axial direction to penetrate the hollow portion and outer circumference. Each through-hole set consists of three radially uniformly spaced-apart through-holes 3 in this embodiment. The wall surface of each through-hole 3 has an inner projection 4 formed at the inner end of the hole. A retainer ring 5 is removably provided by suitable means, e.g., screwing or fitting, in the wall surface of each through-hole 3 at or adjacent to the outer end thereof. A plunger 6 made of a heat-resistant wear-proof material is inserted in each through-hole 3. In this embodiment, each plunger 6 has a flange 7 having an outer diameter smaller than the diameter of the hole 3 but greater than the inner diameter of the inner projection 4 and inner diameter of the retainer ring 5. Thus, the plunger 6 will not be detached from the through-hole 3, while it can be freely moved radially with respect to the hollow shaft 1 over a predetermined range.

The plunger 6 may have any of various other configurations. For example, instead of the flange it may have protuberances provided at an intermediate portion, or it may have a reduced-diameter portion which penetrates the inner projection 4 of the through-hole 3.

The inner end 6*a* of each plunger 6 is in contact with the outer surface of an air tube 10 within the hollow shaft 1. The air tube 10 can be expanded and contracted according to the pressure of compressed air supplied to it through an air supply duct 9 extending through a rotary joint 8 provided adjacent to one end of the hollow shaft 1. Drum rings 15 corresponding in number to the number of the through-hole sets, are loosely fitted on the outer periphery of the hollow shaft 1. Each drum ring 15 covers the outer end of the through-holes 3 in each through-hole set. A pair of support rings 17 made of a wear-proof material are provided at opposite ends of the inner periphery of each drum ring 15. The inner periphery of the support rings 17 are in contact with the outer periphery of the hollow shaft 1. At least one of each pair of support rings 17 has a projecting portion 17*a* projecting from the corresponding end surface of the drum ring 15. Thus, adjacent drum rings 15 are held rotatably as spaced at a predetermined distance on the outer periphery of the hollow shaft 1. Since adjacent drum rings 15 are in contact with each other via the support rings 17, the frictional forces produced on their mating end surfaces are low. Therefore, even with a closely juxtaposed arrangement of a plurality of drum rings 15 between a pair of positioning rings 16 to be described later, there is no possibility of generation of a great winding torque error that would otherwise result from frictional forces on end surfaces of drum rings. The pair of support rings 17 supporting each drum ring 15 may be replaced with a single support ring.

The plurality of drum rings 15 are juxtaposed between the pair of positioning rings 16 which are secured by the screws 18 to the outer periphery of the opposite end portions of the hollow shaft 1. One of the pair of the positioning rings 16 may be replaced with an increased-diameter end portion of hollow shaft 1. In this case, one end of the juxtaposed arrangement of the drum rings 15 is positioned by the increased-diameter end portion, while the other end of the arrangement is positioned by one positioning ring 16 which is detachably mounted on the hollow shaft 1. The outer periphery of each drum ring 15 is provided with a plurality of (in this embodiment three), radially uniformly spaced-apart core-locking mechanisms 14. Each core-locking mechanism 14 consists of a circumferential groove 13 having a sectional profile like a dove-tail and a steel ball 11 received in the groove 13 for rolling in the groove 13 in directions perpendicular to the axial direction of the hollow shaft 1. The ball 11 is fitted in the groove 13 from the shallow bottom end thereof, and is then retained in the groove 13 by providing a retaining pin 12 or the like adjacent to the shallow bottom end of the groove 13.

In this embodiment, three drum rings 15 are provided for driving each core C. With the instant type of sheet winding shaft, the number of drum rings and the drive force for driving each core C are increased with increase in the width of the sheet to be taken up.

To drive this embodiment of the sheet winding shaft for taking up sheets on cores C, the air tube 10 extending in the hollow shaft 1 is preliminarily expanded by supplying compressed air under a controlled pressure according to the required winding force into the air tube 10 through the air supply duct 9. As a result, the plungers 6 are pushed outwardly. The inner periphery of the drum rings 15 is thus urged by the outer end 6*b* of the plungers 6 with a force corresponding to the expanding force applied to the air tube 10. Consequently, the hollow shaft 1 is made integral with the drum rings 15, and rotation of the former is transmitted to the latter. Then, the hollow shaft 1 is driven to cause rotation of the drum rings 15 in unison with the hollow shaft 1. At this time, the core-locking mechanisms 14 provided on the outer periphery of the individual drum rings 15 are operated. More specifically, each steel ball 11 is moved along the associated groove 13 toward the shallow bottom end thereof. This movement of the ball increases the extent to which the ball projects from the outer periphery of the drum ring. The force of contact between the ball and inner periphery of core C thus is progressively increased. Eventually, core C becomes rotated in unison with the associated drum rings, whereby the sheet is taken up on core C. It is possible to control the torque transmitted from the hollow shaft being driven to the drum rings. This means that it is possible to control the frictional force acting between the plungers and the drum rings through control of the air pressure introduced into the air tube 10. Further, each drum ring 15 being driven is supported on the outer periphery of the hollow shaft 1 by a pair of support rings 17. Therefore, the drum rings 15 can be held coaxial with the hollow shaft 1 irrespective of the increase in the weight of the sheet rolls being wound.

The function of the core-locking mechanism 14 will now be described in detail. As the drum rings 15 with core C fitted thereon are relatively rotated (clockwise in FIG. 2 in this embodiment), each ball 11 is moved along the associated groove 13 toward the shallow bottom end thereof and thus progressively projects from the outer periphery of the associated drum ring 15, thus pushing the inner surface of core C outwards. The core thus is secured to and rotated in unison with drum rings 15. Further, when the core is removed, the balls 11 will not detach from the grooves 13 because the grooves 13 have a sectional profile resembling a dove tail and the retaining pin 12 is provided at the shallow bottom end of the groove 13. Further, the balls 11 of the lacking mechanisms 14 can also serve as rollers in the axial direction of the winding shaft to permit smooth installation and removal the cores on and from the shaft.

The pair of positioning rings 16 provided adjacent to the opposite ends of the juxtaposed arrangement of drum rings 15 prevent deviation thereof in the axial direction during the winding operation. In addition, the positioning rings 16 may be displaced in the axial direction by loosening the screws 8 for axially displacing the juxtaposed arrangement of the drum rings 15. This may be done for the purpose of varying the position of contact between the inner periphery of the drum ring 15 and the outer end **6*b* of the plungers 6** in the axial direction. By so doing, it's possible to cause uniform wear of the entire inner periphery of the individual drum rings and thus eliminate fluctuations in the frictional force between the drum rings plungers.

To replace worn-out plunger 6, one of the pair of positioning rings 16 is unlocked with respect to the hollow shaft 1 and then displaced axially to an extent corresponding to about one drum ring. Then drum rings up to one corresponding to the plunger to be replaced are displaced likewise. When the plunger in question is exposed, the retainer ring 5 is removed from the associated through-hole 3. Now, the plunger can be readily taken out from the hole for replacement. In this connection, it is advisable to have the opposed end **17*b* surfaces of the pair of support rings 17 tapered inwardly. In this case, even if an outer end portion of the plungers 6 projects from the outer periphery of the hollow shaft 1, the drum rings can be similarly moved axially by depressing the projecting plungers with the cam action of the tapered end surfaces of the support rings. As an alternative, a weak spring means may be provided between the retainer ring 5 and the flange 7 of the plunger 6 such that the plunger is biased toward the center of the hollow shaft 1** and held retracted into the shaft while no pressurized air is supplied to the air tube. This arrangement also facilitates the axial movement of the drum rings. Further, the retainer rings may be dispensed with, if necessary, because the plunger will not be detached from the through-hole in the hollow shaft unless the drum ring is removed.

Figure 5:
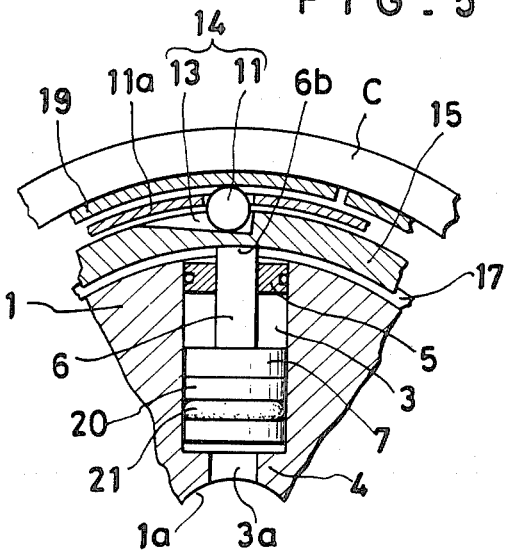
FIG. 5 is an enlarged sectional view showing an essential part of the winding shaft shown in FIG. 4.
Figure 4:
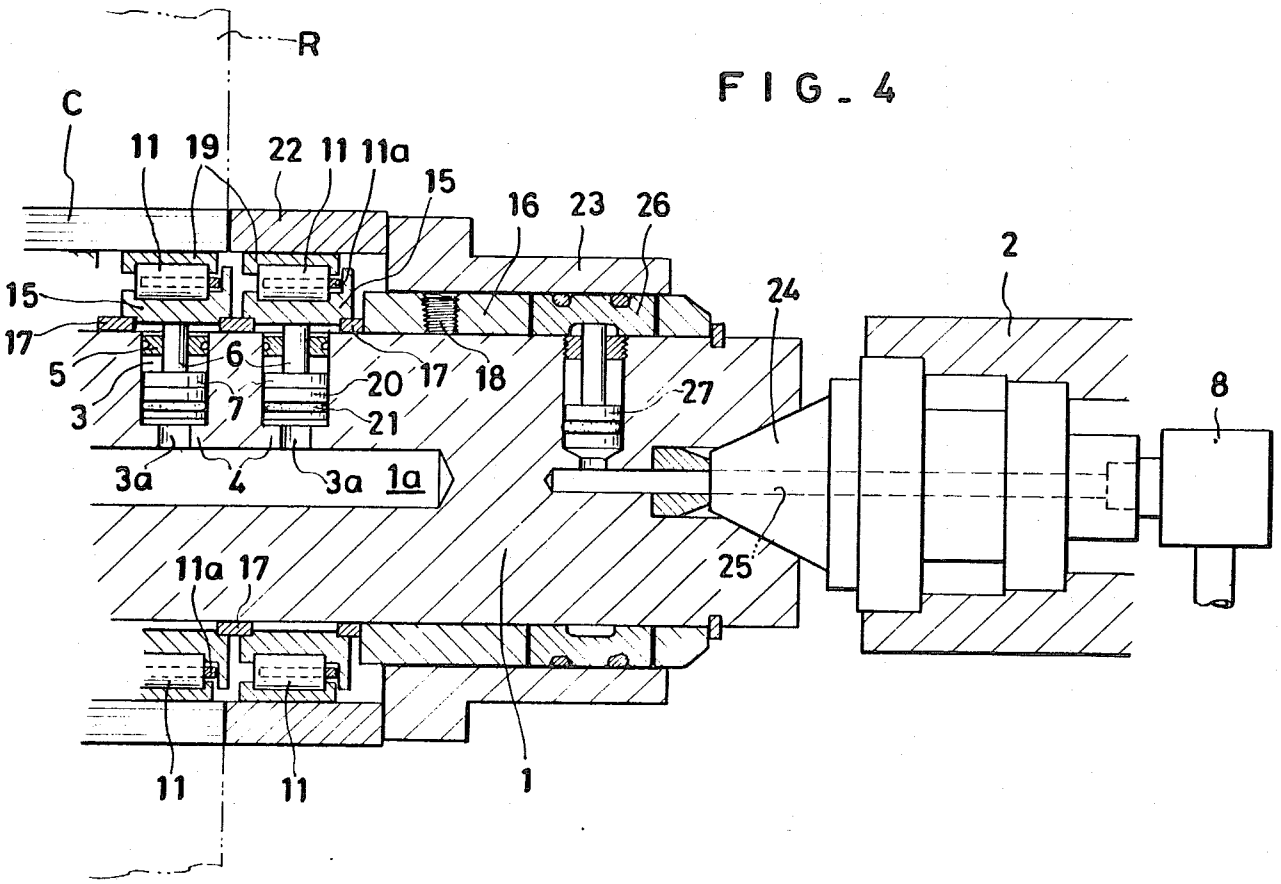
FIG. 4 is a sectional view showing an essential part of a second embodiment of the winding shaft according to the invention.

FIGS. 4 and 5 illustrate a second embodiment of the winding shaft according to the invention. In the preceding embodiment, the air tube 10 is expanded to cause the plungers 6 to urge the drum rings 15. In the instant embodiment, each plunger 6 has a piston provided on the inner side of the flange 7, and a luid pressure supplied to the hollow portion **1*a* of the shaft 1 directly causes the plungers 6 to urge the drum rings 15. More specifically, the wall surface of each through-hole 3 provided in the peripheral wall of the hollow shaft 1 has the inner projection 4 provided at the inner end, and the retainer ring 5 removably fitted in the through-hole 3 adjacent to the outer end thereof was an inner annular groove, in which an O-ring is fitted. The plunger 6 is inserted in the through-hole 3 with its outer end portion 6*b* projecting from the retainer ring 5. The plunger 6 has a piston 20 provided on the inner side of the flange 7. Piston 20 has substantially the same diameter as the diameter of the through-hole 3. Its outer periphery is formed with an annular groove, in which an O-ring 21 is fitted. The hole 3 serves as a cylinder, and compressed air supplied to the interior of the hollow shaft 1 enters the hole 3 through an inlet 3*a* to urge the piston 20. As a result, the outer end 6*b* of the plunger 6 is caused to urge the inner periphery of the drum ring 15 which is loosely fitted on the outer periphery of the hollow shaft 1, thus making the drum ring 15 integral with the hollow shaft 1**.

In this embodiment, the outer periphery of the drum ring 15 has a plurality of radially uniformly spaced-apart, circumferential inclined grooves 13. The rollers 11 held by a roller holder ring **11*a* are provided in respective circumferential inclined grooves 13. The rollers 11 constitute core-locking mechanism 14 together with expansible ring 18 provided on the inner periphery of core C. As the hollow shaft 1 is rotated, each roller 11 is moved along the inclined groove 13 toward the shallow end thereof. The extent, to which the roller 11 projects from the drum ring 15, is thus progressively increased to cause an expansible ring 19** to expand and urge the inner periphery of core C. The core is thus secured to the hollow shaft. Through control of the pressure of the pressurized fluid supplied to the hollow shaft interior, the force with which the drum rings are urged by the plungers, i.e., the frictional force, can be controlled to control the torque transmitted form the hollow shaft to the drum rings with the driving of the hollow shaft.

Worn-out plungers 6 may be replaced in the manner as described in connection with the previous embodiment. That is, one of positioning rings 16 is loosened and axially displaced, and the drum rings up to the one corresponding to the plunger to be replaced are also axially displaced. Then the retainer ring is removed, and the plunger is taken out for replacement. The plunger may be formed integrally with or separately from the piston.

With this embodiment of the sheet winding shaft, the pressurized fluid for controlling the torque transmitted to the drum rings is supplied from a hollow shaft drive mechanism, which is not shown but is provided on the left side of the hollow shaft in FIG. 4.

Further, after slit sheets have been taken up, the sheet winding shaft with the sheet rolls is withdrawn in the axial direction from its set position for the winding. Then, the sheet rolls are taken out and a core or cores held in a core feeder are supplied to set positions. Thereafter, the winding shaft is returned to the set position, whereby the cores are automatically installed. For installing core C on the sheet winding shaft at an accurate set position thereof, a spacer 22 is provided and held between core C and a core positioning ring 23 against axial movement. To this end, the other end of the winding shaft is supported by a center cone 24 rotatably supported in the bearing 2. To permit automatic locking and releasing of the core positioning ring 23 with respect to the winding shaft, the end of the hollow shaft is provided with a radially expansible mechanism. The radially expansible mechanism consists of a plurality of radially spaced-apart pistons 27 provided in an end portion of the hollow shaft 1 and on expansible ring 26 with a gap fitted on the outer periphery of the hollow shaft portion provided with the pistons 27. The plurality of pistons 27 can be pushed radially outwardly by pressurized fluid supplied through a pressurized fluid supply line 25, which passes through the rotary joint 8 provided at an end of the center cone 24 and extends through the center thereof, whereby the expansible ring 26 is expanded to lock the positioning ring 23 which is positioned on the outer periphery of the expansible ring 26.

It will be understood from the above description of the embodiments of the winding shaft according to the invention that, each drum ring can be held coaxial with the hollow shaft by the support rings irrespective of the increase of the sheet roll weight or area of the drum ring inner periphery. Thus, it is possible to obtain high quality sheet rolls. In addition, the position of contact between the plunger and the drum ring inner periphery can be varied within a certain range. It is thus possible to suppress or avoid local wear of the drum ring inner periphery, thus reducing fluctuation in the winding force applied to the individual drum rings and extending the life thereof. Further, the plungers are completely safe from falling into the interior of the hollow shaft, and it can be set in and taken out from the through-hole from the outer periphery side of the hollow shaft. Thus, the plungers can be readily assembled and replaced. This means that the replacement of the drum rings with those of a different size for cores of a different size can be readily accomplished with the winding shaft held mounted in a slitter/rewinder.

One mode of operation of taking up slit sheets with a slitter/rewinder employing the sheet winding shaft according to the invention will now be described with reference to FIG. 6.

Sheet S paid off main sheet roll So by feed rollers 33 driven by a feed-out motor $M_1$ is slit by a slitter 35 into a plurality of slit sheets, which are taken up on a winding shaft 32 driven by a winding motor $M_2$ to form sheet rolls R. During the winding of the slit sheets, the winding hardness thereof is controlled by movable touch rollers 34 urged against the sheet rolls R being wound.

The feed-out motor $M_1$ may be a variable speed motor or a constant-speed motor provided with a continuous speed change unit. As variable speed motor may be used a DC motor, an induction motor with an inverter, an induction motor with an electromagnetic coupuing, an oil hydraulic motor, etc.

The sheet feed speed is gradually increased at the start of paying off sheet S from the sheet roll So, and it is also gradually increased and reduced at the start and end of taking up slit sheets on the winding shaft. Otherwise, it is held at a constant speed. The speed change pattern is preset in a speed setter 55 associated with the feed-out motor $M_1$. The sheet feed speed may be set for the entire winding process or only for speed increase and decrease periods. The electric signal of the speed setter is fed to a speed controller for motor $M_1$ for speed control.

Either a signal from speed detector 54 provided on the feed-out motor $M_1$ or a signal obtained through direct detection of the sheet speed is fed to a speed controller 53 for the take-out motor $M_2$ when the speed of the sheet S being paid off is being increased or reduced or is constant.

To speed controller 53 is also fed a signal from a winding amount detector 47. The winding amount detector 47 detects the amount of sheet taken up from the angle of a support arm of the touch roller 34. The required revolving rate $V/\pi D$ of the sheet roll R thus is calculated from the speed V of the sheet S and the diameter D of the sheet roll R. The winding motor $M_2$ is controlled through a drive speed control mechanism according to the value obtained by adding a value corresponding to an adequate amount of slip to the calculated revolving rate or by multiplying the revolving rate by a factor representing the slip. Means for increasing the speed of a drive shaft 31 to an extent corresponding to a slip may be provided either in an electric control unit or in a mechanical torque transmission unit.

The winding motor $M_2$, like the feed-out motor $M_1$, may be a variable speed motor or a constant-speed motor with a continuous speed change unit. Where winding motor $M_2$ is a variable-speed motor, e.g., a DC motor, a stationary speed controller is use as the drive speed control mechanism to control the revolving rate according to an electric signal from the speed controller 53.

The winding amount detector 47 may be of any well-known type. For example, it may be the one in which the angle of a support arm of the touch roller 34 is detected with a potentiometer or the like, or it may be one which detects the roll diameter from the length of the supplied sheet. Further, it may be one which detects the roll diameter without contact with the sheet roll. The diameter of the wound sheet roll may be calculated from the detected value.

With the conventional winding shaft with drum rings, only the frictional torque between the shaft and drum rings has been considered, and the speed of the shaft has been set to a high speed or slowed down by the operator when it increases excessively. In such case, heat generation in the frictional section is not uniform, resulting in variations in the coefficient of friction, and thus has an adverse effect on the frictional torque, which is very important. According to the invention, the shaft drive speed is set with reference to the amount of sheet taken up such that the revolving rate of sheet roll being paid off is slightly higher than the sheet feed speed, that is, the slip between hollow shaft and drum rings is held at a slight value at all time. The heat of friction is thus reduced so as to greatly extend the life of the frictional section and save time and labor for the maintenance and repair. Further, since the coefficient of friction can be made constant, the precision of control of the winding torque according to the friction can be increased. Meanwhile, an output signal from the winding tension controller 46 is coupled to pressure regulator 45 for conversion to a necessary operational quantity, i.e., fluid pressure, which is coupled to the sheet winding shaft 32.

FIG. 7 is a block diagram showing an example of a winding tension controller 46. The required winding amount for the winding tension pattern corresponding to the material of the sheet taken up, winding conditions, etc. is set in a winding amount versus winding tension setter 41 by operating a variable resistor knob, a digital switch, a keyboard, etc. Pressure regulator 45 calculates a winding tension signal corresponding to the instantaneous winding amount according to a winding amount signal supplied from the winding amount detector 47 mentioned above and the setting signal from the winding amount versus winding tension setter 41. The formula for calculation of the instantaneous winding tension is adopted according to design conditions. For example, when the winding diameter is detected at the winding amount, the instantaneous winding tension F can be given as $$F = Fo\left(1 - \beta\frac{R - R_{min}}{R_{max} - R_{min}}\right)$$

where R is the winding diameter, $R_{min}$ is the core diameter, $R_{max}$ is the final winding diameter, Fo is the preset winding tension at the start of winding, and $\beta$ is the tension reduction factor. Operatonal quantity control unit 42 calculates the necessary winding torque, and also an operational quantity for obtaining the desired frictional torque, from the setting signal from the take-up amount versus winding tension setter 41 and the winding amount signal from the winding amount detector 47 and amplifies the result. The output of operational quantity control unit 42 is fed to the pressure regulator 45 for conversion to the required operational quantity, which is coupled to the winding shaft. In the embodiment of the winding shaft shown in FIG. 1, the air tube 10 constitutes an expansion mechanism, and the air pressure constitutes the operational quantity. In this case, the frictional torque transmitted to the drum rings is determined by the force with which the plungers of the winding shaft are urged, which force is determined by the pressure of air supplied to the air tube. The relation between the supplied air pressure (i.e., operational quantity) and the transmitted torque can be derived from the dimensions, material, etc. of the sheet winding shaft and expressed as a formula. A more accurate formula may be obtained by determining constants by empirically obtaining supplied air pressure versus transmitted torque characteristics. Further, the torque required to be transmitted can be obtained from the winding diameter and winding tension. The supplied air pressure, therefore, generally can be expressed as a function of variables representing the winding amount and winding tension and including the coefficient of friction and other constants. Fluid pressure calculator 43 may be provided with the function of air pressure calculation using this formula. Where a constant in the formula varies with the material, dimensions, etc. of the sheet, a constant setter may be provided. The fluid pressure signal (i.e., required operational quantity signal) obtained from the fluid pressure calculator 43 is amplified in an amplifier 44 to be fed to the pressure regulator 4. The pressure regulator 45 provides air under a pressure based on the amplified fluid pressure signal, the air being supplied to the air tube in the winding shaft 32 through the tube and rotary joint. Thus, the operator need only set a winding amount versus winding tension pattern in the setter 41, and then the frictional torque of the sheet winding shaft can be accurately controlled automatically so as to provide a winding tension corresponding to the winding amount. It is thus possible to obtain high quality taken-up sheet rolls without need of any skill on the part of the operator.

FIGS. 8 and 9 show examples of sheet winding shaft frictional torque controller applied to the case where the winding tension is controlled by the sheet winding shaft according to the invention. In these instances, high quality sheet rolls can be obtained through control of the winding tension or winding torque according to the winding amount. The relation between the winding tension or winding torque and winding amount can be expressed either as a graph or as a formula.

In the example of FIG. 8, the required frictional torque of the winding shaft 32 calculated by a small computer from a preset winding tension versus winding amount relation and the detected drive torque coupled to the drive shaft 31 as detected by a torque detector 48 are compared for feed-back control.

In the example of FIG. 9, a winding tension calculator 49 obtains the winding tension by dividing the detected torque by the sheet roll diameter. The calculated winding tension is compared with a preset tension in a comparator 50. The output of the comparator 50 is coupled to the pressure regulator 45 through the operational quantity control unit 42. In this case, it is possible to set a winding torque virsus winding amount relation.

The torque detector 48 maybe one which detects the twist of a torsion shaft provided in a transmission mechanism for driving the hollow shaft. Alternatively, it may be one which detects a belt tension in a belt transmission mechanism or a reaction force acting on a torque detection gear in a gear transmission mechanism. As a further alternative, it may be one which detects a reaction force acting on a hollow shaft drive motor. Where the motor is a DC motor, it is possible to detect the motor current and use the detected current as a torque signal.

In either of the cases of FIGS. 8 and 9, the feedback control cannot be accomplished for each of a plurality of slit sheet rolls takes on a common winding shaft because the individual winding sheet rolls do not have equal diameters at all times. However, substantially effective feedback control can be obtained by taking the sum of the frictional torques between the shaft and the drum rings for the individual winding sheet rolls and comparing the sum with the actual torque of the common drive shaft. The sheet winding tension control thus can be carried out more accurately.

FIGS. 10 and 11 show examples of a sheet winding shaft frictional torque controller, in which the drive torque of the drive shaft is also controlled according to a preset tension or torque versus winding amount relation to prevent excessive torque as in the prior art sheet winding shaft.

FIG. 10 shows a basic arrangement. A winding torque controller 42 shown enclosed by a phantom line receives data on the prevailing winding amount from take-up amount detector 47 and data on the required tension from tension versus winding amount relation setter 41 and calculates the required winding torque corresponding to the sheet width. As in the previous embodiments or the examples of FIGS. 8 and 9, a friction regulator, e.g., a pressure regulator, in a mechanism for transmission of friction between the hollow shaft and the drum rings is controlled. It is of course possible to use a winding torque versus winding amount relation setter. According to the invention, the drive torque of the drive shaft is also controlled according to the calculated winding torque obtained from a separately provided winding torque controller or a common controller. More specifically, the drive motor may be provided with a torque regulator 57, e.g., magnetic powder clutch, and the magnetic powder clutch may be controlled such that the transmitted torque is equal to or slightly higher than the calculated winding torque. The magnetic powder clutch is convenient as a torque regulator. From the standpoint of energy saving, however, a DC motor or induction motor with an inverter is preferabaly used.

Where both the drive torque of the drive shaft and frictional torque of friction between the shaft and drum rings are simultaneously controlled, the friction regulator can control the friction between the shaft and drum rings to zero slip through control of the two torques noted above to the desired winding torque. In this case, each slit sheet can be taken up with the required torque with the hollow shaft and drum rings rotated together just as in the ordinary winding shaft. An advantage of the invention, however, is that upon occurrence of a difference in the winding slit sheet roll diameter a slip of a greater diameter sheet rolling is produced. It is thus possible to continue simultaneous winding of a plurality of slit sheets even if the winding sheet rolls being wound have different diameters. The slip that is produced in this case is very small compared with the slip in the case of the prior art winding shaft.

However, in case where the slip is very small so that the friction between the hollow shaft and drum rings is liable to become a static friction or a dynamic friction, a certain constant slip may be provided by controlling the drive torque on the side of the drive shaft to be slightly higher than the desired torque in the tension control. In the example of FIG. 10 the drive torque of the drive shaft and fructional torque of friction between the hollow shaft and drum rings are controlled by the common torque controller 42. However, it is possible to provide an exclusive torque controller for each torque.

FIG. 11 shows a more practical example. In this instance, a pressure regulator using an air tube 36 is provided as a friction regulator for the drive shaft. The winding torque calculator 56 is adapted to receive a winding amount detector 47 and a winding tension signal from the winding tension setter 41, calculate the signals to produce a signal of winding torque necessary at any time during the winding process, and output the produced signal to the fluid pressure calculator 43 and, at the same time, also to a comparator 51 in order to control the drive motor $M_2$ for rotating the core of the winding shaft. The comparator 51 is adapted to compare the winding torque signal from the winding torque calculator 56 with the actual torque detection signal from the torque detector 48 to obtain the difference as a movement signal, and supply the movement signal to an amplifier 52. The output signal from the amplifier 52 is transmitted to a speed controller 53 in which a speed command signal is calculated from the detected signal from the line speed detector 54 and the detected signal from the winding amount detector 47 on the basis of the speed-torque characteristics of the drive motor $M_2$. The calculated speed command signal is fed to the drive motor $M_2$. Thus, the drive motor is driven at the required speed (winding speed) and with the required torque by the drive motor controller 53, which receives a line speed signal, a take-up amount signal and a winding torque signal. Torque detector 48 is also provided for feedback control. In this example the drive torque of the drive shaft is controlled by feedback control, differently from in the examples of FIGS. 8 and 9 in which the frictional torque is feedback controlled. These feedback controls may be suitably combined depending on the condition of application of the invention.

It is to be understood that not only the friction between the hollow shaft and the drum rings is controlled according to the computer-calculated winding torque, but the drive torque of the shaft is controlled to a calculated value corresponding to a preset tension or a slightly greater value. Thus, the slip between the hollow shaft and drum rings may be unnecessary or very slight. The actual winding tension thus can be stabilized without being adversely affected by the frlction.

What is claimed is:

1. A sheet winding shaft comprising:

a hollow shaft having a plurality of through-holes formed in the peripheral wall thereof so as to be disposed radially at predetermined intervals, the wall surfaces of said hollow shaft defining each of said plurality of through-holes each of said plurality of through-holes having an inner projection provided at the inner end of each said through-hole;

a plurality of retainer rings each provided in the outer open end of each said through-hole;

a plurality of drum rings rotatably fitted about said hollow shaft to close the outer open end of each said through-hole and each having an inner periphery serving as a frictional suface;

core-locking means each provided on the outer periphery of each said drum ring to come into contact with the inner periphery of a core;

a plurality of pairs of support rings, each pair of which has outer peripheries fixed to the opposite ends of the inner periphery of each said drum ring rings and each pair having the inner peripheries thereof kept in contact with the outer periphery of said hollow shaft, thereby supporting each of said drum rings on said hollow shaft;

a plurality of plungers each provided with a flange and each movably inserted into each said through-hole, each said plunger having a length large enough to project both outwardly from each of said retainer rings and inwardly from each said inner projections, each of said flanges having a diameter larger than the inner diameter of each said retainer ring and also larger than the inner diameter of the inner projections; and an expansible air tube provided in said hollow shaft and, when being expanded, adapted to outwardly urge said plungers within said through-holes.

2. A sheet winding shaft according to claim 1, wherein said core-locking means comprise circumferential grooves formed in the periphery of said each drum ring so as to have slanted bottom surfaces, and steel balls rolling on said slanted bottom surfaces of said circumferential grooves.

3. A sheet winding shaft according to claim 1, wherein said core-locking means comprise inclined grooves formed in the periphery of said each drum ring, rollers in said inclined grooves, roller holder rings for holding said rollers so as to be rollable on said inclined grooves, and expansible rings provided on the inner periphery of said core.

4. A sheet winding shaft according to claim 3, wherein said each inclined groove has thereon opposed end surfaces tapered to have a trapezoidal sectional profile.

5. A sheet winding shaft according to claim 1, wherein one of the support rings constituting said each pair of support rings for supporting each said drum ring has a projection extending outwardly from the end face of each said drum ring.

6. The winding shaft according to claim 1, wherein said urging means includes:

a winding amount detector;

a winding amount versus winding tension relation setter for setting a winding amount versus winding tension characteristic pattern and calculating the instantaneous winding tension according to a winding amount signal from said winding amount detector; and winding tension control means having an operational quantity controller for calculating an operational quantity for obtaining a desired winding torque from said winding amount signal and a signal representing the calculated instantaneous winding tension and amplifying the calculated operational quantity, and a frictional force controller for converting an output signal from said operational quantity controller into a different operational quantity.

* * * * *